US009365057B1

(12) United States Patent
Seino et al.

(10) Patent No.: US 9,365,057 B1
(45) Date of Patent: Jun. 14, 2016

(54) PRINTING UNIT AND THERMAL PRINTER

(71) Applicant: Seiko Instruments Inc., Chiba-shi, Chiba (JP)

(72) Inventors: Takumi Seino, Chiba (JP); Kouhei Miyawaki, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 15/049,909

(22) Filed: Feb. 22, 2016

(30) Foreign Application Priority Data

Feb. 27, 2015 (JP) ..... 2015-039007

(51) Int. Cl.
*B41J 11/04* (2006.01)
*B41J 2/315* (2006.01)

(52) U.S. Cl.
CPC . *B41J 11/04* (2013.01); *B41J 2/315* (2013.01)

(58) Field of Classification Search
CPC ..... B41J 11/02; B41J 11/04; B41J 11/053; B41J 11/057; B41J 11/06; B41J 11/08; B41J 11/10; B41J 11/13
See application file for complete search history.

(56) References Cited

U.S. PATENT DOCUMENTS 6,412,995 B2 * 7/2002 Togashi ..... B41J 11/08 347/220
7,446,790 B2 * 11/2008 Takabatake ..... B41J 2/32 347/220
8,585,305 B2 * 11/2013 Naito ..... B41J 29/02 347/220
8,842,142 B2 * 9/2014 Bouverie ..... B41J 2/325 347/220
2012/0327167 A1 12/2012 Tsuchiya et al.

FOREIGN PATENT DOCUMENTS

JP 2013-6288 A 1/2013

* cited by examiner

*Primary Examiner* — Kristal Feggins
(74) *Attorney, Agent, or Firm* — Brinks Gilson & Lione

(57) ABSTRACT

A printer unit including: a platen roller including a driven gear; a drive source configured to rotate the platen roller about a predetermined axis; a frame, which is configured to rotatably support the platen roller and to which the drive source is assembled; a reduction gear configured to transmit a driving force of the drive source to the driven gear in a decelerated manner; a thermal head to be held in press contact with an outer peripheral surface of the platen roller; a gearbox portion, which is formed on the frame and to which the driven gear and the reduction gear are assembled, the gearbox portion having an opening for assembling the reduction gear; and a gear cover configured to close at least a part of the opening of the gearbox portion, the gearbox portion having a recessed portion recessed in a direction intersecting an axial direction of the predetermined axis, the gear cover including: a hook portion to be engaged with the gearbox portion; and a projecting portion to be fitted to the recessed portion of the gearbox portion.

6 Claims, 9 Drawing Sheets

PRINTING UNIT AND THERMAL PRINTER

RELATED APPLICATIONS

This application claims priority under 35 U.S.C. §119 to Japanese Patent Application No. 2015-039007 filed on Feb. 27, 2015, the entire content of which is hereby incorporated by reference.

BACKGROUND OF THE INVENTION

1. Field of the Invention

The present invention relates to a printing unit and a thermal printer.

2. Description of the Related Art

Hitherto, a printing unit of thermal printers is configured to perform printing by heating a printing surface of a recording sheet with heating elements of a thermal head to develop a color on the printing surface while feeding the recording sheet through rotation of a platen roller under a state in which the recording sheet is nipped between the platen roller and the thermal head. The platen roller includes a gear at one end portion of a shaft. The platen roller is rotated through transmission of power of a motor mounted on a frame of the printing unit to the gear of the platen roller via a reduction gear.

A gearbox portion configured to receive the reduction gear and the gear of the platen roller is formed on the frame of the printing unit. An opening is formed in the gearbox portion in consideration of easiness of assembly of the reduction gear, the platen roller, and the like. The opening of the gearbox portion is covered by a gear cover. The gear cover is engaged with the gearbox portion by snap-fitting.

In the related-art printing unit, however, due to deflection of the gear cover that may be caused due to drop impact, loads applied from the platen roller and the like to the gear cover, and the like, the gearbox portion and the gear cover may be disengaged from each other so that the gear cover drops off from the gearbox portion.

In view of the above-mentioned matter, a printing unit capable of preventing drop of a gear cover, and a thermal printer including the printing unit are demanded in this technical field.

SUMMARY OF THE INVENTION

According to one embodiment of the present invention, there is provided a printing unit, including: a platen roller including a driven gear; a drive source configured to rotate the platen roller about a predetermined axis; a frame, which is configured to rotatably support the platen roller and to which the drive source is assembled; a reduction gear configured to transmit a driving force of the drive source to the driven gear in a decelerated manner; a thermal head to be held in press contact with an outer peripheral surface of the platen roller; a gearbox portion, which is formed on the frame and to which the driven gear and the reduction gear are assembled, the gearbox portion having an opening for assembling the reduction gear; and a gear cover configured to close at least a part of the opening of the gearbox portion, the gearbox portion having a recessed portion recessed in a direction intersecting an axial direction of the predetermined axis, the gear cover including: a hook portion to be engaged with the gearbox portion; and a projecting portion to be fitted to the recessed portion of the gearbox portion.

According to this structure, when an external force is applied to the printing unit due to drop impact or the like, the platen roller rotatably supported on the frame is moved along the axial direction of the predetermined axis corresponding to a rotation axis of the platen roller (hereinafter simply referred to as "axial direction"). Then, a load of the platen roller is applied to the gear cover covering the opening of the gearbox portion along the axial direction via the driven gear of the platen roller, which is assembled to the gearbox portion. According to the one embodiment of the present invention, the gearbox portion has the recessed portion recessed in the direction intersecting the axial direction, and the gear cover has the projecting portion to be fitted to the recessed portion of the gearbox portion. Thus, movement of the gear cover in the axial direction can be regulated while maintaining the fitting state under a state in which the projecting portion is arranged in the recessed portion. Therefore, even when the load is applied from the platen roller to the gear cover along the axial direction, drop of the gear cover from the gearbox portion is prevented. Thus, the printing unit capable of preventing the drop of the gear cover can be attained.

In the above-mentioned printing unit according to the one embodiment of the present invention, the gear cover is formed to be elongated in a predetermined direction when viewed in the axial direction, the projecting portion is formed on the driven gear side with respect to an intermediate portion of the gear cover in the predetermined direction when viewed in the axial direction, and the hook portion is formed on a side opposite to the projecting portion across the intermediate portion of the gear cover in the predetermined direction when viewed in the axial direction.

According to this structure, the gear cover includes a side wall portion formed upright from a peripheral edge of a main body portion configured to cover the driven gear and the reduction gear. Thus, the side wall portion functions as a rib so that the main body portion is less liable to be deflected. With this, the gear cover is less liable to be deflected even when the load is applied from the platen roller along the axial direction, thereby being capable of preventing disengagement of the hook portion. Therefore, the drop of the gear cover can be prevented more securely.

In the above-mentioned printing unit according to the one embodiment of the present invention, the gear cover includes: a main body portion configured to cover the driven gear and the reduction gear when viewed in the axial direction; and a side wall portion formed upright from a peripheral edge of the main body portion.

According to this structure, the gear cover includes the side wall portion formed upright from the peripheral edge of the main body portion configured to cover the driven gear and the reduction gear. Thus, the side wall portion functions as a rib so that the main body portion is less liable to be deflected. With this, the gear cover is less liable to be deflected even when the load is applied from the platen roller along the axial direction, thereby being capable of preventing disengagement of the hook portion. Therefore, the drop of the gear cover can be prevented more securely.

In the above-mentioned printing unit according to the one embodiment of the present invention, the gear cover is formed to be elongated in a predetermined direction when viewed in the axial direction, and a deflection direction of the hook portion intersects the predetermined direction.

According to this structure, the gear cover is formed to be elongated in the predetermined direction when viewed in the axial direction. Thus, when the load is applied from the platen roller to the gear cover along the axial direction, the gear cover is to be deflected in the predetermined direction. According to the one embodiment of the present invention, the deflection direction of the hook portion intersects the predetermined direction. Thus, even when the load is applied from the platen roller to the gear cover along the axial direction so that the gear cover is deflected, the deflection direction of the gear cover intersects the deflection direction of the hook portion, thereby being capable of preventing the disengagement of the hook portion that may be caused due to the deflection of the gear cover. Thus, the drop of the gear cover can be prevented more securely.

In the above-mentioned printing unit according to the one embodiment of the present invention, the gear cover is formed of a material having higher toughness than that of the frame.

According to this structure, the gear cover is formed of a material having higher toughness than that of the frame. Thus, the gear cover can be deflected under a state in which the projecting portion of the gear cover is fitted to the recessed portion of the gearbox portion so that the hook portion of the gear cover is engaged with the gearbox portion. Therefore, assembly of the gear cover to the gearbox portion can be facilitated.

According to one embodiment of the present invention, there is provided a thermal printer including the above-mentioned printing unit.

According to this structure, the thermal printer includes the above-mentioned printing unit, thereby obtaining the thermal printer capable of preventing the drop of the gear cover.

As described above, according to the printing unit and the printer of the one embodiment of the present invention, the gearbox portion has the recessed portion recessed in the direction intersecting the axial direction, and the gear cover has the projecting portion to be fitted to the recessed portion of the gearbox portion. Thus, the movement of the gear cover in the axial direction may be regulated while maintaining the fitting state under the state in which the projecting portion is arranged in the recessed portion. Therefore, even when the load is applied from the platen roller to the gear cover along the axial direction, the drop of the gear cover from the gearbox portion is prevented. As a result, the printing unit capable of preventing the drop of the gear cover may be attained.

DETAILED DESCRIPTION OF THE PREFERRED EMBODIMENTS

Now, an embodiment of the present invention is described with reference to the accompanying drawings.

Figure 1:
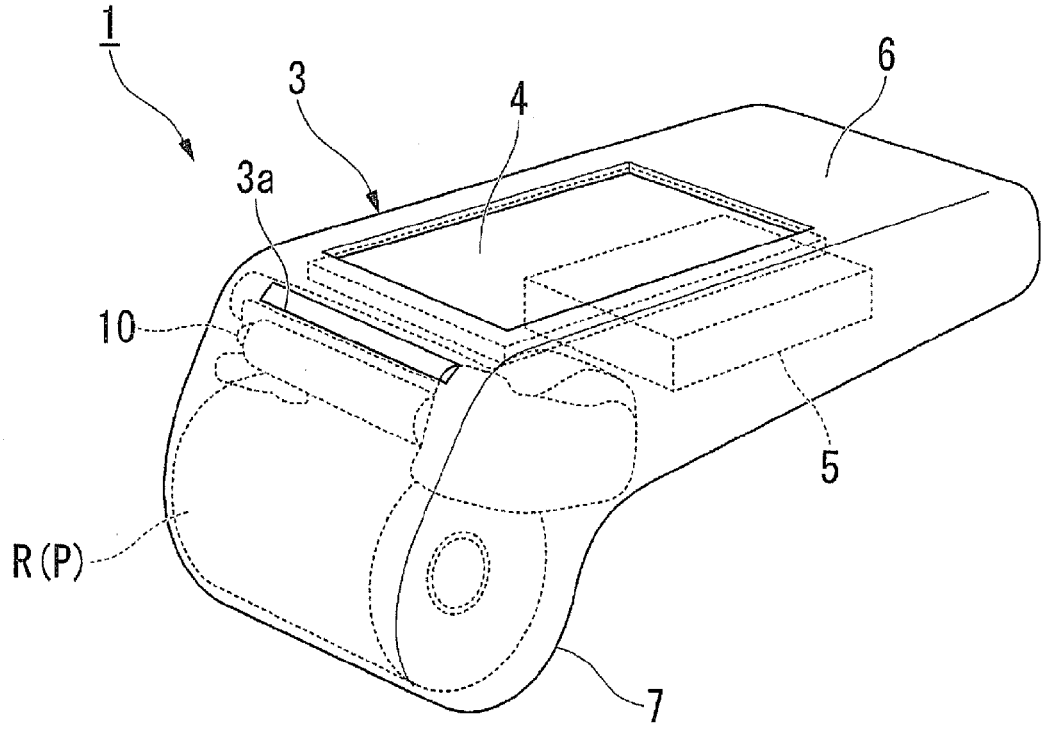
FIG. 1 is a perspective view of a thermal printer.

FIG. 1 is a perspective view of a thermal printer. As illustrated in FIG. 1, a thermal printer 1 is capable of performing printing on a recording sheet P. The recording sheet P is a heat sensitive sheet that develops a color when heat is applied thereto, and is used suitably for printing a variety of labels, receipts, and tickets. The recording sheet P is set in the thermal printer 1 in a state of a roll sheet R obtained by rolling the recording sheet P so as to have a hollow hole, and printing is performed on a part drawn from the roll sheet R.

The thermal printer 1 includes a casing 3, a display unit 4, a control unit 5, and a printing unit 10. The casing 3 formed into a hollow box-shape is made of a metal material or plastic such as ABS or a composite material of ABS and polycarbonate. The casing 3 includes a main body portion 6 having a rectangular parallelepiped shape, and a roll sheet receiving portion 7 formed at the one end portion of the main body portion 6 in a longitudinal direction thereof so as to be bent toward one side of a thickness direction of the main body portion 6. The printing unit 10 is received at one end portion of the main body portion 6 in the longitudinal direction. A discharge port 3*a* is formed in one end surface of the main body portion 6 in the longitudinal direction. The discharge port 3*a* is configured to discharge the recording sheet P printed by passing through the printing unit 10. The display unit 4 is arranged on a main surface of the main body portion 6, which faces the other side in the thickness direction. The display unit 4 is, for example, a liquid crystal panel. The display unit 4 is connected to the control unit 5, and is configured to display various kinds of information. The roll sheet receiving portion 7 is configured to receive the roll sheet R.

Figure 2:
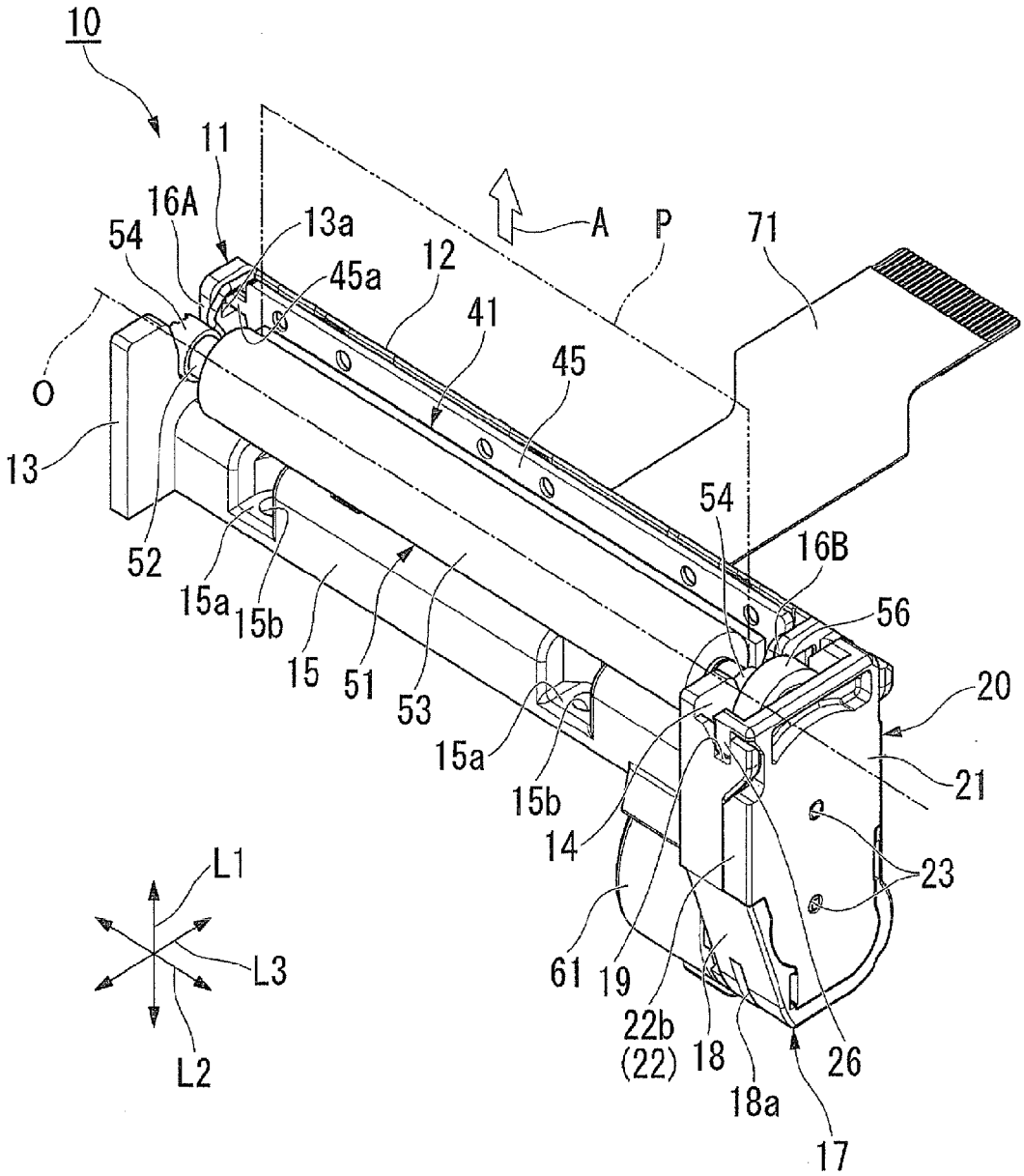
FIG. 2 is a perspective view of a printing unit.
Figure 3:
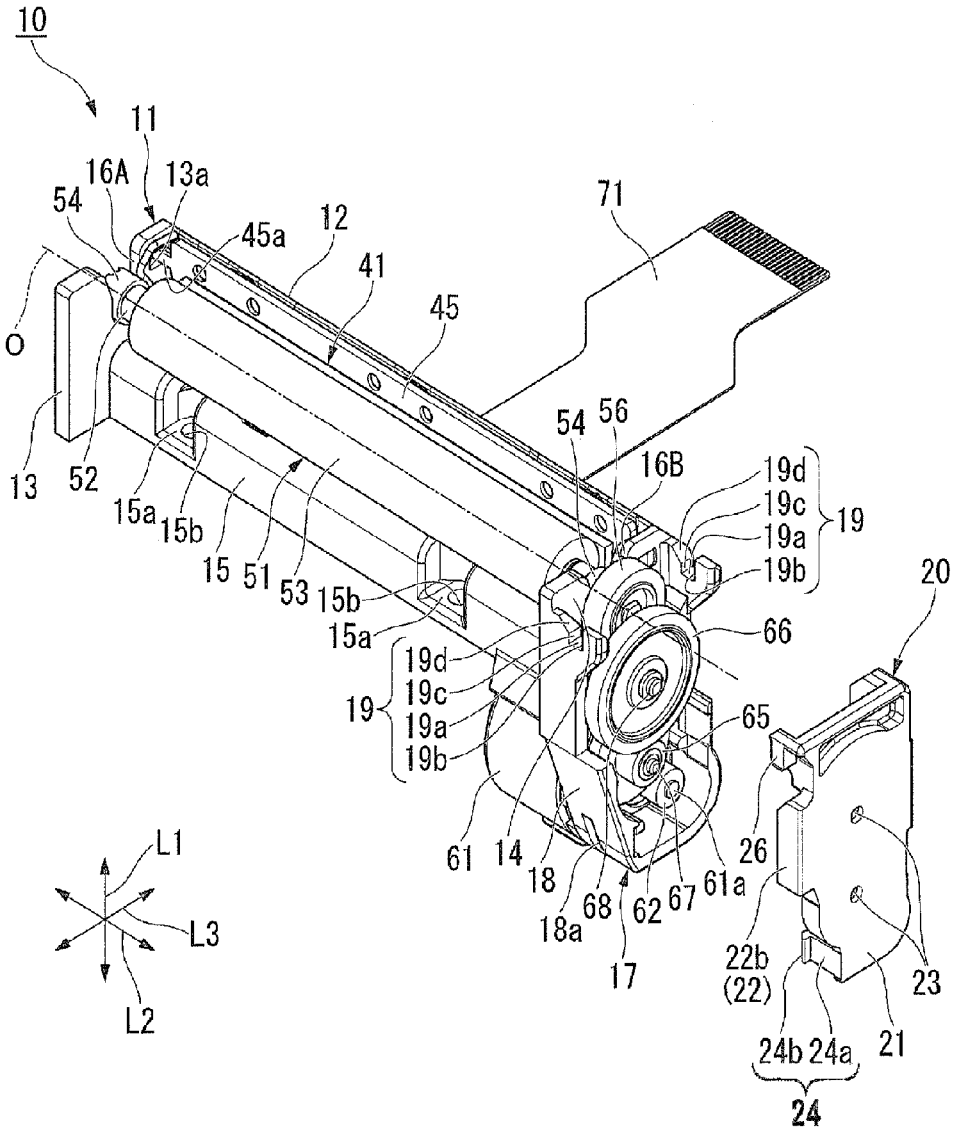
FIG. 3 is an exploded perspective view of the printing unit.
Figure 4:
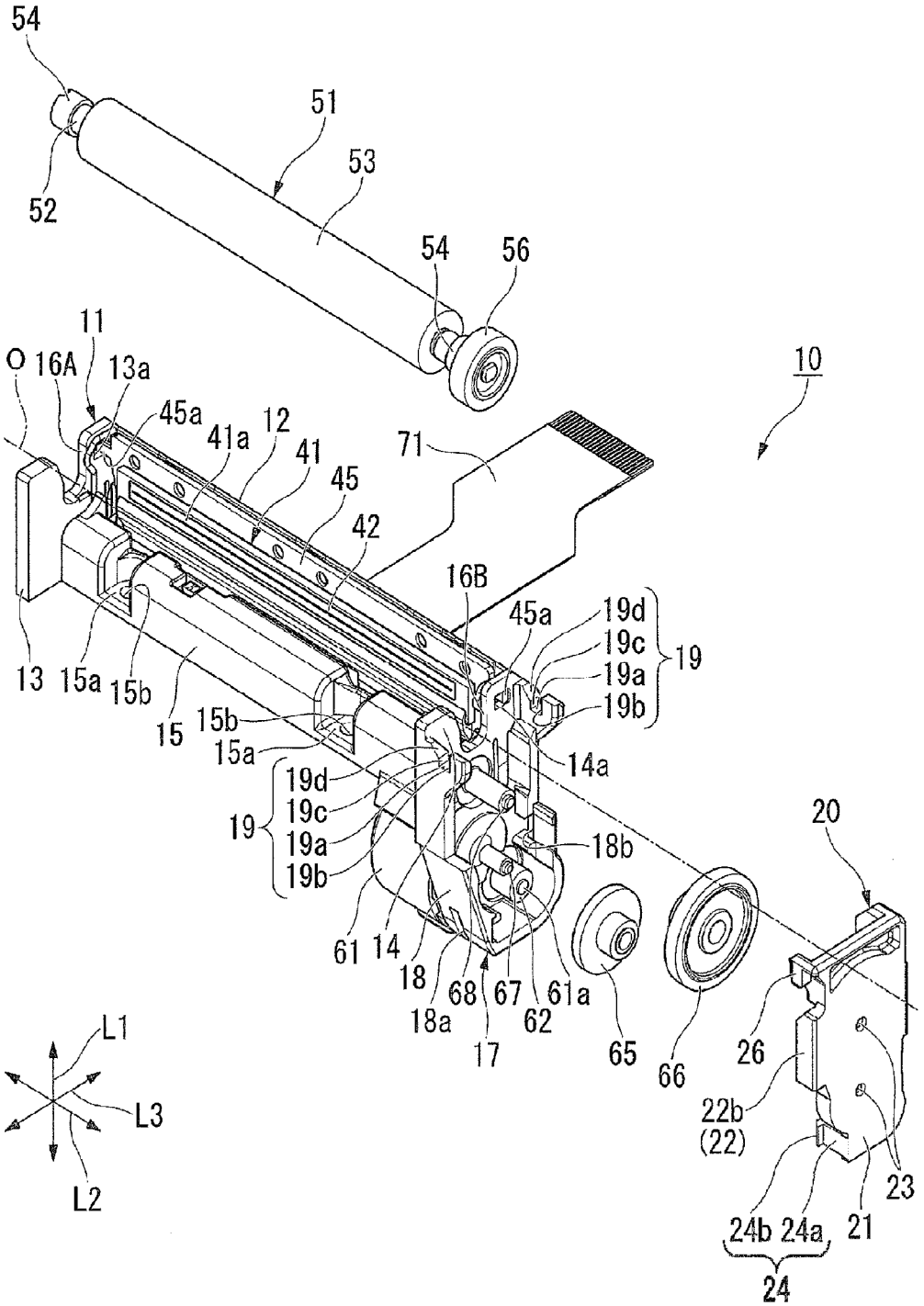
FIG. 4 is an exploded perspective view of the printing unit.
Figure 5:
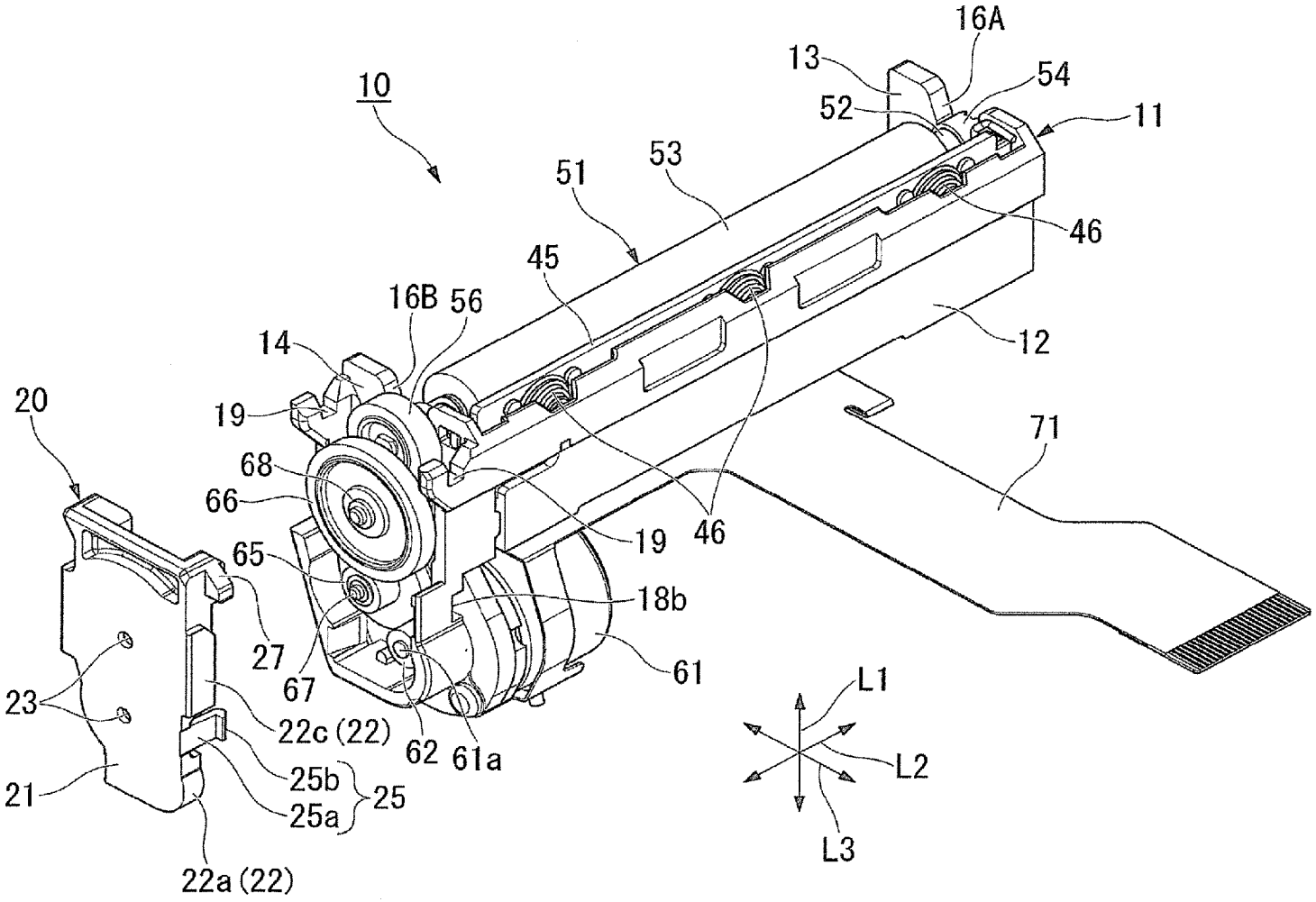
FIG. 5 is an exploded perspective view of the printing unit.

FIG. 2 is a perspective view of the printing unit. FIG. 3 to FIG. 5 are exploded perspective views of the printing unit. As illustrated in FIG. 3, the printing unit 10 includes a platen roller 51 including a driven gear 56, a motor 61 (corresponding to a "drive source" in the claims) configured to rotate the platen roller 51 about a rotation axis O (corresponding to a "predetermined axis" in the claims), a main body frame 11 (corresponding to a "frame" in the claims), which is configured to rotatably support the platen roller 51 and to which the motor 61 is assembled, a first reduction gear 65 and a second reduction gear 66 (hereinafter referred to as "respective reduction gears 65 and 66") configured to transmit a driving force of the motor 61 to the driven gear 56 in a decelerated manner, and a thermal head 41 to be held in press contact with an outer peripheral surface of the platen roller 51.

As illustrated in FIG. 2, the printing unit 10 is configured to discharge the recording sheet P passing between the platen roller 51 and the thermal head 41 in a direction indicated by the arrow A. Mainly in the description for the printing unit 10 below, a direction along the arrow A is defined as a vertical direction L1, and the direction indicated by the arrow A is defined as an upper side. Further, a direction along the rotation axis O of the platen roller 51 is defined as an axial direction L2. In addition, a direction orthogonal to the vertical direction L1 and the axial direction L2 is defined as a fore-and-aft direction L3, and the platen roller 51 side with respect to the thermal head 41 in the fore-and-aft direction L3 is defined as a front side.

The main body frame 11 is formed of, for example, a plate member such as a polycarbonate resin containing glass fibers. The main body frame 11 is formed into a U-shape opened toward the front side when viewed in the vertical direction L1. Specifically, the main body frame 11 includes a rear plate portion 12 extending in the axial direction L2, a first side wall portion 13 formed upright from one end portion of the rear plate portion 12 in the axial direction L2 toward the front side, a second side wall portion 14 formed upright from the other end portion of the rear plate portion 12 in the axial direction L2 toward the front side and a lower side, and a support portion 15 formed between the first side wall portion 13 and the second side wall portion 14.

As illustrated in FIG. 5, the rear plate portion 12 is formed into a plate shape having a thickness in the fore-and-aft direction L3. As illustrated in FIG. 4, the first side wall portion 13 is formed into a plate shape having a thickness in the axial direction L2. A first roller insertion groove 16A cut downward is formed in an upper end edge of the first side wall portion 13.

The second side wall portion 14 is formed into a plate shape having a thickness in the axial direction L2. The second side wall portion 14 extends from the other end portion of the rear plate portion 12 in the axial direction L2 toward the front side, and further extends therefrom toward the lower side. A second roller insertion groove 16B cut downward is formed in an upper end edge of the second side wall portion 14. The second roller insertion groove 16B is formed to match with the first roller insertion groove 16A in shape and formation position when viewed in the axial direction L2. The platen roller 51 is removably inserted into the first roller insertion groove 16A and the second roller insertion groove 16B (hereinafter referred to as "respective roller insertion grooves 16A and 16B").

The motor 61 is mounted on a part of the second side wall portion 14, which is located lower than a portion connecting the second side wall portion 14 and the rear plate portion 12. The motor 61 is mounted on an inner side of the second side wall portion 14, and an output shaft 61*a* of the motor 61 passes through the second side wall portion 14 to protrude outward from the second side wall portion 14. The motor 61 is connected to the control unit 5 (see FIG. 1) through intermediation of a flexible substrate 71 having a wiring pattern (not shown) printed and wired thereon. The motor 61 is configured to be driven based on a signal from the control unit 5.

A gearbox portion 17 is formed on the outer side of the second side wall portion 14. The gearbox portion 17 includes a peripheral wall portion 18 formed upright from a peripheral edge of the second side wall portion 14 toward the outer side. The peripheral wall portion 18 is formed into a U-shape opened toward the upper side when viewed in the axial direction L2. The gearbox portion 17 is opened toward the outer side.

Recessed portions 19 recessed downward are respectively formed in an upper end edge of the peripheral wall portion 18 on the front side and an upper end edge thereof on a rear side. The pair of recessed portions 19 are formed to match with each other in shape and position when viewed in the fore-and-aft direction L3. Each of the recessed portions 19 is formed so that an opening thereof is enlarged toward the upper side when viewed in the fore-and-aft direction L3. Specifically, each of the recessed portions 19 includes, when viewed in the fore-and-aft direction L3, a bottom portion 19*a* extending along the axial direction L2, an outer wall portion 19*b* extending from an outer end portion of the bottom portion 19*a* toward the upper side, an inner wall portion 19*c* extending from an inner end portion of the bottom portion 19*a* toward the upper side, and an inclined wall portion 19*d* extending obliquely toward the upper side from an upper end edge of the inner wall portion 19*c* toward one side in the axial direction L2. A height of the inner wall portion 19*c* is approximately half a height of the outer wall portion 19*b*. A position of an upper end edge of the inclined wall portion 19*d* substantially matches with that of an upper end edge of the outer wall portion 19*b* in the vertical direction L1.

A first hole portion 18*a* and a second hole portion 18*b* are formed in the peripheral wall portion 18. The first hole portion 18*a* is formed at a lower portion of a part of the peripheral wall portion 18, which faces the front side. The first hole portion 18*a* is formed into a rectangular shape elongated in the vertical direction L1 when viewed in the fore-and-aft direction L3. The second hole portion 18*b* is formed at a lower portion of a part of the peripheral wall portion 18, which faces the rear side. The second hole portion 18*b* is formed into a rectangular shape elongated in the vertical direction L1 when viewed in the fore-and-aft direction L3. The second hole portion 18*b* is formed on the upper side with respect to the first hole portion 18*a* in the vertical direction L.

As illustrated in FIG. 3, the reduction gears 65 and 66 are assembled to the gearbox portion 17. The first reduction gear 65 is supported in a freely rotatable manner by a first rotation shaft 67 arranged upright from the second side wall portion 14. The first reduction gear 65 meshes with a drive gear 62 mounted on the output shaft 61*a* of the motor 61. The second reduction gear 66 is supported in a freely rotatable manner by a second rotation shaft 68 arranged upright from the second side wall portion 14 at the upper side with respect to the first rotation shaft 67. The second reduction gear 66 meshes with the first reduction gear 65. The reduction gears 65 and 66 are assembled in an opening of the gearbox portion 17.

The support portion 15 is formed into a columnar shape extending along the axial direction L2. One end portion of the support portion 15 in the axial direction L2 is connected to an inner surface of the first side wall portion 13, and the other end portion of the support portion 15 in the axial direction L2 is connected to an inner surface of the second side wall portion 14. A pair of mounting portions 15*a* recessed downward when viewed in the fore-and-aft direction L3 are formed in the support portion 15. The pair of mounting portions 15*a* are formed with an interval secured therebetween in the axial direction L2. A through hole 15*b* passing through a bottom portion of each of the mounting portions 15*a* in the vertical direction is formed in the bottom portion of each of the mounting portions 15*a*. The main body frame 11 is mounted to the casing 3 by inserting fastening members such as bolts into the through holes 15*b* of the support portion 15.

As illustrated in FIG. 4, the thermal head 41 is configured to perform printing on the recording sheet P (see FIG. 2). The thermal head 41 is formed into a rectangular shape having its longitudinal direction defined as the axial direction L2 when viewed in the fore-and-aft direction L3. The thermal head 41 is arranged under a state in which the longitudinal direction of the thermal head 41 matches with the width direction of the recording sheet P. On a head surface 41*a* of the thermal head 41, a large number of heating elements 42 are arrayed in the axial direction L2. The head surface 41*a* is opposed to a printing surface of the recording sheet P, and the recording sheet P may be nipped between the head surface 41*a* and an outer peripheral surface of the platen roller 51. The thermal head 41 is connected to the control unit 5 (see FIG. 1) through intermediation of the flexible substrate 71. A driver IC (not shown) mounted on the thermal head 41 is configured to control heat generation of the heating elements 42 based on the signal from the control unit 5. Through the control of the heat generation of the heating elements 42, the thermal head 41 prints various kinds of letters and figures on the printing surface of the recording sheet P.

The thermal head 41 is bonded and fixed onto a head support member 45 supported on the main body frame 11. The head support member 45 is a plate-like member having its longitudinal direction defined as the axial direction L2, and the thermal head 41 is bonded and fixed onto a front surface of the head support member 45. The head support member 45 is arranged between the first side wall portion 13 and the second side wall portion 14 and between the rear plate portion 12 and the support portion 15.

As illustrated in FIG. 5, elastic members 46 configured to bias the head support member 45 and the rear plate portion 12 in directions away from each other are interposed between the head support member 45 and the rear plate portion 12. That is, the elastic members 46 are configured to press the head support member 45 constantly toward the front side. The plurality of (in the first embodiment, three) elastic members 46 are arrayed in the axial direction L2 with intervals secured therebetween.

As illustrated in FIG. 4, a pair of stoppers 45*a* configured to regulate a pivot range of the head support member 45 are formed at upper end portions of the head support member 45. Each stopper 45*a* extends outward in the axial direction L2 of the head support member 45, and is formed so as to face each of an inside of a hole portion 13*a* formed in an upper part of the first side wall portion 13 of the main body frame 11 and an inside of a hole portion 14*a* formed in an upper part of the second side wall portion 14. The stoppers 45*a* are movable inside the hole portions 13*a* and 14*a*, respectively, along with the pivot of the head support member 45, and may be brought into contact with end surfaces of the hole portions 13*a* and 14*a*, respectively. Through the contact of the stoppers 45*a* with the end surfaces of the hole portions 13*a* and 14*a*, the pivot amount of the head support member 45 is regulated.

As illustrated in FIG. 2, the platen roller 51 is arranged so as to be opposed to the thermal head 41, and is rotated about the rotation axis O under a state in which the recording sheet P is nipped between the platen roller 51 and the thermal head 41, to thereby convey the recording sheet P in the direction indicated by the arrow A. The platen roller 51 includes a roller shaft 52, a roller main body 53 mounted on the roller shaft 52, and a pair of bearings 54 mounted at both ends of the roller shaft 52. The roller shaft 52 is formed slightly longer than the separation distance between the first side wall portion 13 and the second side wall portion 14 of the main body frame 11. The roller main body 53 is made of, for example, rubber, and is arranged along the axial direction L2 uniformly over the entire region excluding portions corresponding to both the ends of the roller shaft 52.

The pair of bearings 54 of the platen roller 51, which are mounted on both ends thereof, are inserted into the roller insertion grooves 16A and 16B of the main body frame 11, respectively. With this, the platen roller 51 is held so as to be rotatable about the rotation axis O relative to the main body frame 11 and removable from the main body frame 11. The platen roller 51 is arranged so that the roller main body 53 is brought into contact with the thermal head 41 under the state in which the platen roller 51 is inserted into the roller insertion grooves 16A and 16B and the recording sheet P drawn out from the roll sheet R (see FIG. 1) is nipped between the platen roller 51 and the thermal head 41.

As illustrated in FIG. 3, the driven gear 56 is fixed on the other end portion of the platen roller 51 in the axial direction L2. The driven gear 56 is assembled to an upper part of the gearbox portion 17 when the platen roller 51 is held on the first side wall portion 13 and the second side wall portion 14. At this time, the driven gear 56 is overlapped with the second reduction gear 66 when viewed in the axial direction L2, and is arranged on the inner side with respect to the second reduction gear 66 to mesh with the second reduction gear 66. With this, a rotational driving force from the motor 61 is transmitted to the driven gear 56 via the reduction gears 65 and 66. The platen roller 51 is rotated under a state of being held on the first side wall portion 13 and the second side wall portion 14, thereby being capable of conveying the recording sheet P (see FIG. 2).

As illustrated in FIG. 2, a gear cover 20 configured to close the entire opening of the gearbox portion 17 when viewed in the axial direction L2 is mounted on the opening of the gearbox portion 17. It is preferred that the gear cover 20 be formed of a material having higher toughness than that of the main body frame 11, and for example, the gear cover 20 is formed of an ABS resin.

Figure 6:
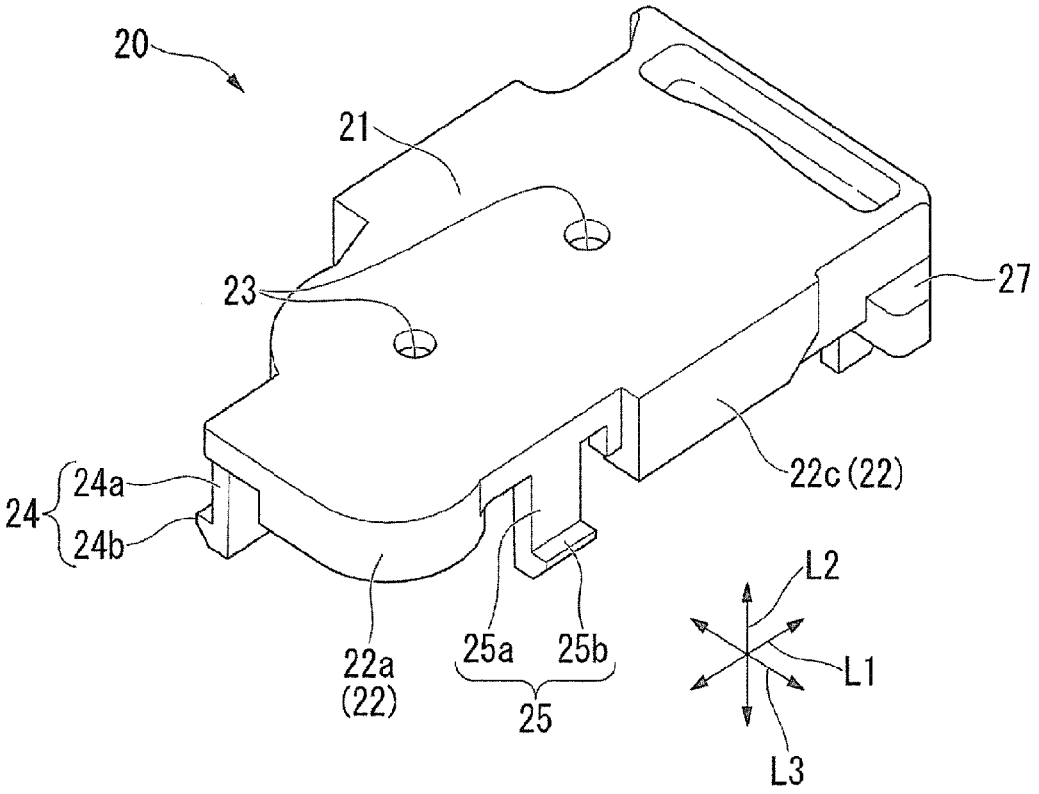
FIG. 6 is a perspective view of a gear cover.
Figure 7:
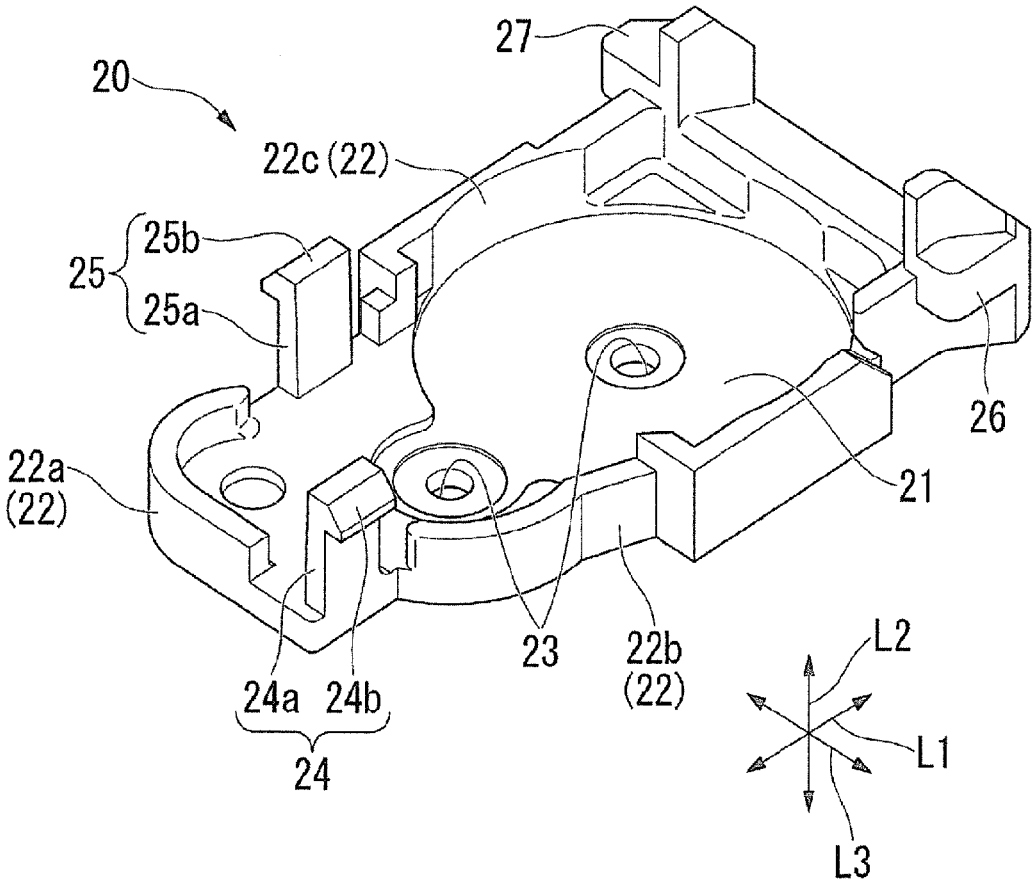
FIG. 7 is a perspective view of the gear cover.

FIG. 6 and FIG. 7 are perspective views of the gear cover. Note that, FIG. 6 is a perspective view of the gear cover when viewed from the outer side, and FIG. 7 is a perspective view of the gear cover when viewed from the inner side. As illustrated in FIG. 7, the gear cover 20 includes a main body portion 21, and a cover side wall portion 22 (corresponding to a "side wall portion" in the claims) formed upright from a peripheral edge of the main body portion 21. Note that, directions used in the description for the gear cover 20 below correspond to directions under a state in which the gear cover 20 is mounted on the gearbox portion 17 (state illustrated in FIG. 2).

The main body portion 21 covers the driven gear 56 and the reduction gears 65 and 66 when viewed in the axial direction L2 under the state in which the gear cover 20 is mounted on the gearbox portion 17 (see FIG. 2 and FIG. 3). The main body portion 21 has a thickness in the axial direction L2, and is a plate-like member having a rectangular shape elongated in the vertical direction L (corresponding to a "predetermined direction" in the claims). A shape of the main body portion 21 when viewed in the axial direction L2 corresponds to a shape of the gearbox portion 17 when viewed in the axial direction L2 (see FIG. 2). A pair of through holes 23 passing through the main body portion 21 in the axial direction L2 is formed in a center part of the main body portion 21. Distal end portions of the first rotation shaft 67 and the second rotation shaft 68 (see FIG. 3) are inserted into the through holes 23 under the state in which the gear cover 20 is mounted on the gearbox portion 17.

As illustrated in FIG. 4 and FIG. 7, a first hook portion 24 to be engaged with the gearbox portion 17 is formed at a front lower part of the main body portion 21 so as to be upright toward the one side in the axial direction L2. The first hook portion 24 includes a plate spring portion 24*a* deformable to be deflected in the fore-and-aft direction L3, and a projecting portion 24*b* formed to project from a distal end of the plate spring portion 24*a* toward the front side. The projecting portion 24*b* is engageable with the first hole portion 18*a* of the gearbox portion 17.

A second hook portion 25 to be engaged with the gearbox portion 17 is formed at a rear lower part of the main body portion 21 so as to be upright toward the one side in the axial direction L2. The second hook portion 25 includes a plate spring portion 25*a* deformable to be deflected in the fore-and-aft direction L3, and a projecting portion 25*b* formed to project from a distal end of the plate spring portion 25*a* toward the rear side. The second hook portion 25 is formed on the upper side with respect to the first hook portion 24 in the vertical direction L1. The projecting portion 25*b* is engageable with the second hole portion 18*b* of the gearbox portion 17.

As illustrated in FIG. 7, the cover side wall portion 22 includes a lower side wall portion 22*a* formed on a lower part thereof, a front side wall portion 22*b* formed on a front part thereof, and a rear side wall portion 22*c* formed on a rear part thereof. The lower side wall portion 22*a* is formed in a region from a lower end edge of the main body portion 21 across a corner portion of the rear lower part of the main body portion 21 to a lower part of a rear end edge of the main body portion 21. The lower side wall portion 22*a* is formed under a state of securing clearances with respect to the first hook portion 24 and the second hook portion 25 (hereinafter referred to as "respective hook portions 24 and 25").

The front side wall portion 22*b* is formed in a region of a front end edge of the main body portion 21 from a portion on the upper side with respect to the first hook portion 24 to a corner portion of the front upper part of the main body portion 21. The front side wall portion 22*b* is formed under a state of securing a clearance with respect to the first hook portion 24.

On an upper end portion of the front side wall portion 22*b*, there is formed a first protruding portion 26 to be fitted to the recessed portion 19 (see FIG. 3) of the gearbox portion 17 on the front side. The first protruding portion 26 protrudes from the front side wall portion 22*b* toward the front side. A lower end portion of the first protruding portion 26 is formed to extend along the fore-and-aft direction L3 when viewed in the axial direction L2. Both side surfaces of the first protruding portion 26, which face both sides in the axial direction L2, respectively, are each formed into a planar shape orthogonal to the axial direction L2.

The rear side wall portion 22*c* is formed in a region of a rear end edge of the main body portion 21 from a portion on the upper side with respect to the second hook portion 25 to a corner portion of a rear upper part of the main body portion 21. The rear side wall portion 22*c* is formed under a state of securing a clearance with respect to the second hook portion 25.

As illustrated in FIG. 6, on an upper end portion of the rear side wall portion 22*c*, there is formed a second protruding portion 27 to be fitted to the recessed portion 19 (see FIG. 3) of the gearbox portion 17 on the rear side. The second protruding portion 27 protrudes from the rear side wall portion 22*c* toward the rear side. A lower end portion of the second protruding portion 27 is formed to extend along the fore-and-aft direction L3 when viewed in the axial direction L2. Both side surfaces of the second protruding portion 27, which face both the sides in the axial direction L2, respectively, are each formed into a planar shape orthogonal to the axial direction L2. As illustrated in FIG. 7, the second protruding portion 27 is formed to match with the first protruding portion 26 in shape and position when viewed in the fore-and-aft direction L3. As illustrated in FIG. 3 and FIG. 7, the first protruding portion 26 and the second protruding portion 27 (hereinafter referred to as "respective projecting portions 26 and 27") are positioned on the driven gear 56 side with respect to an intermediate portion of the gear cover 20 in the vertical direction L1 when viewed in the axial direction L2 under the state in which the gear cover 20 is mounted on the gearbox portion 17. Further, the above-mentioned respective hook portions 24 and 25 are positioned on a side opposite to the respective projecting portions 26 and 27 across the intermediate portion of the gear cover 20 in the vertical direction L1 when viewed in the axial direction L2 under the state in which the gear cover 20 is mounted on the gearbox portion 17.

Next, a method of mounting the gear cover 20 is described. Note that, it is suggested to see FIG. 2 to FIG. 7 regarding reference symbols of the respective components of the printing unit 10 in the description below.

Figure 8:
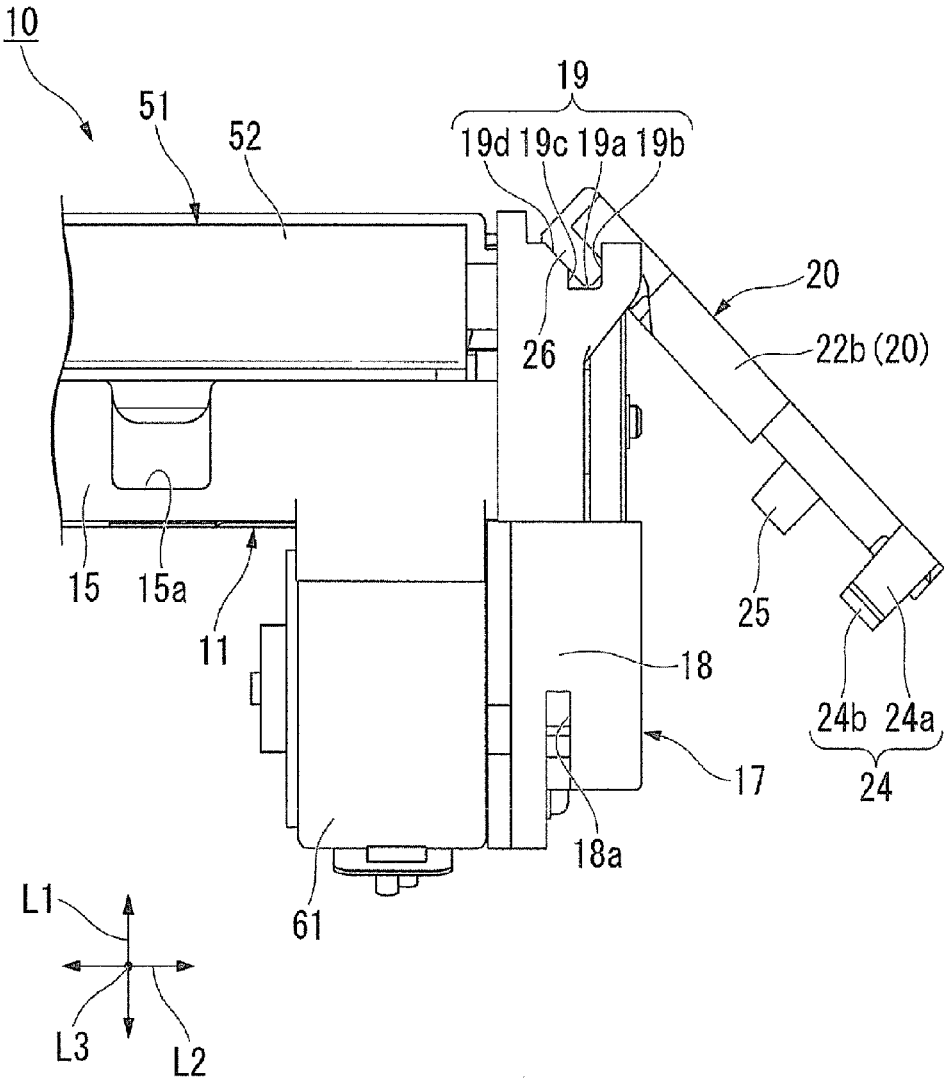
FIG. 8 is a front view of the printing unit at the time of mounting the gear cover.
Figure 9:
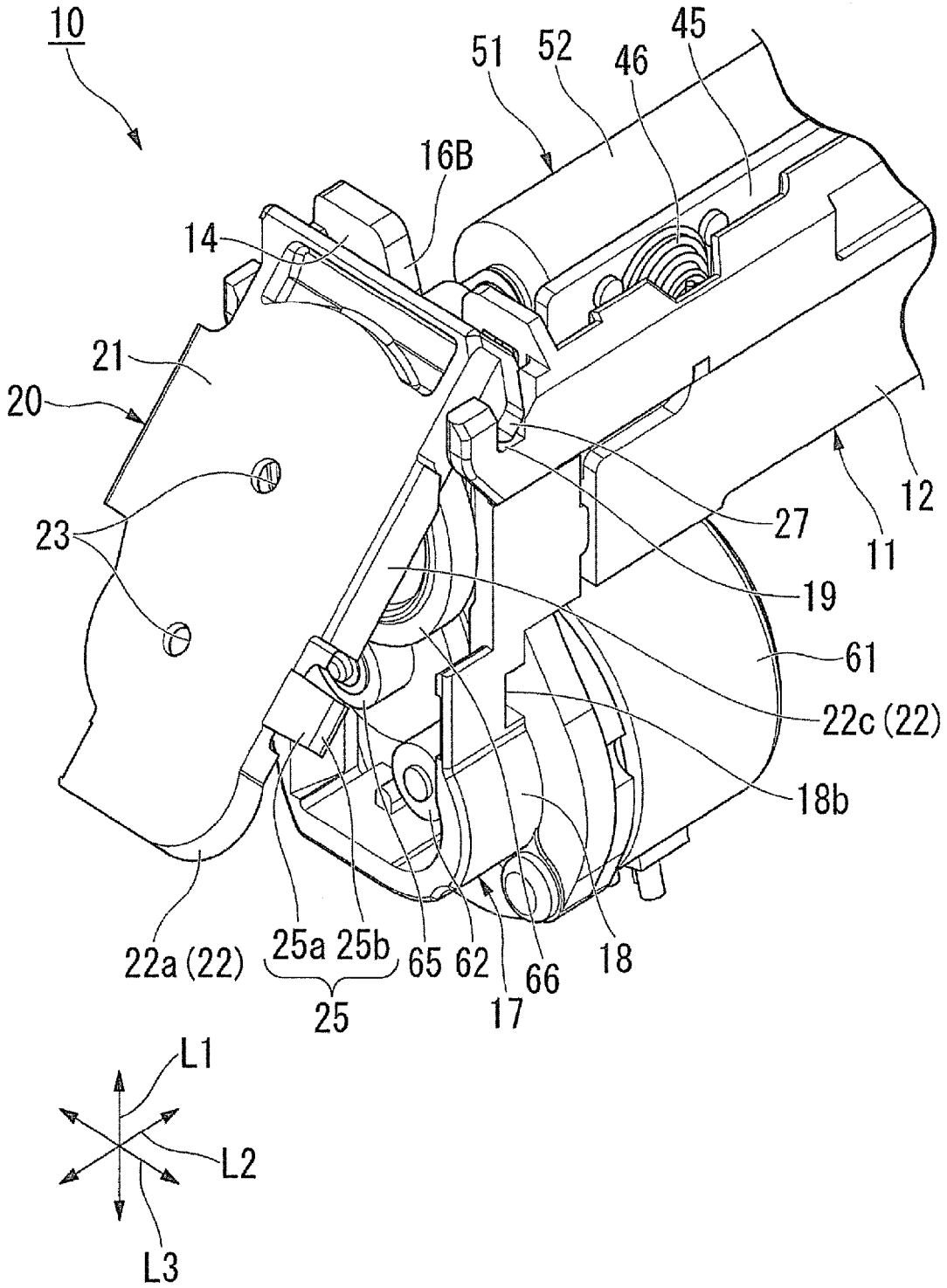
FIG. 9 is a perspective view of the printing unit at the time of mounting the gear cover.

FIG. 8 is a front view of the printing unit at the time of mounting the gear cover. FIG. 9 is a perspective view of the printing unit at the time of mounting the gear cover. First, the platen roller 51 is held on the main body frame 11. Next, as illustrated in FIG. 8 and FIG. 9, the first protruding portion 26 of the gear cover 20 is fitted to the recessed portion 19 of the gearbox portion 17 on the front side, and the second protruding portion 27 is fitted to the recessed portion 19 on the rear side. At this time, the gear cover 20 is in a state in which the main body portion 21 is inclined so that a lower part of the gear cover 20 is positioned outward with respect to an upper part thereof when viewed in the fore-and-aft direction L3. At this time, side surfaces of the respective projecting portions 26 and 27, which face the one side in the axial direction L2, are held in contact with the inclined wall portions 19*d* of the respective recessed portions 19.

Next, the lower part of the gear cover 20 is moved toward the one side in the axial direction L2 so as to come closer to the gearbox portion 17 while maintaining the fitting between the projecting portion 26 and the recessed portion 19 and between the projecting portion 27 and the recessed portion 19. With this, the lower side wall portion 22*a*, a lower part of the front side wall portion 22*b*, and the respective hook portions 24 and 25 of the gear cover 20 are fitted to the inner side of the peripheral wall portion 18 of the gearbox portion 17. Then, the projecting portion 24*b* of the first hook portion 24 is engaged with the first hole portion 18*a* of the gearbox portion 17, and the projecting portion 25*b* of the second hook portion 25 is engaged with the second hole portion 18*b* of the gearbox portion 17. With this, as illustrated in FIG. 2, the gear cover 20 is engaged with the gearbox portion 17 by snap-fitting. Through the procedure described above, the mounting of the gear cover 20 is completed.

As described above, the printing unit 10 in this embodiment includes the gearbox portion 17 and the gear cover 20. The gearbox portion 17 is formed on the main body frame 11, and the driven gear 56 and the respective reduction gears 65 and 66 are assembled to the gearbox portion 17. The gearbox portion 17 has the opening for assembling the respective reduction gears 65 and 66. The gear cover 20 is configured to close the opening of the gearbox portion 17. The gearbox portion 17 has the recessed portions 19 recessed in the vertical direction L1 intersecting the axial direction L2 of the rotation axis O. The gear cover 20 has the respective hook portions 24 and 25 to be engaged with the gearbox portion 17, and the respective projecting portions 26 and 27 to be fitted to the recessed portions 19 of the gearbox portion 17.

When an external force is applied to the printing unit 10 due to drop impact or the like, the platen roller 51 rotatably supported on the main body frame 11 is moved along the axial direction L2 of the rotation axis O. Then, a load of the platen roller 51 is applied to the gear cover 20 covering the opening of the gearbox portion 17 along the axial direction L2 via the driven gear 56 of the platen roller 51, which is assembled to the gearbox portion 17, and the second reduction gear 66 arranged between the driven gear 56 and the gear cover 20. According to this embodiment, the gearbox portion 17 has the recessed portions 19 recessed in the vertical direction L1, and the gear cover 20 has the respective projecting portions 26 and 27 to be fitted to the recessed portions 19 of the gearbox portion 17. Thus, movement of the gear cover 20 in the axial direction L2 can be regulated while maintaining the fitting state under a state in which the respective projecting portions 26 and 27 are arranged in the recessed portions 19. Therefore, even when the load is applied from the platen roller 51 to the gear cover 20 along the axial direction L2, drop of the gear cover 20 from the gearbox portion 17 is prevented. Thus, the printing unit 10 capable of preventing the drop of the gear cover 20 can be attained.

Further, the respective projecting portions 26 and 27 are formed on the driven gear 56 side with respect to the intermediate portion of the gear cover 20 in the vertical direction L1 when viewed in the axial direction L2. Thus, the driven gear 56 is arranged at a position closer to the respective projecting portions 26 and 27 than the respective hook portions 24 and 25. With this, even when a load is applied from the platen roller 51 to the gear cover 20 along the axial direction L2, the load can be concentrated on the fitting portions between the recessed portion 19 of the gearbox portion 17 and the projecting portion 26 of the gear cover 20 and between the recessed portion 19 of the gearbox portion 17 and the projecting portion 27 of the gear cover 20. With this, loads applied to the respective hook portions 24 and 25 can be reduced, thereby being capable of preventing disengagement between the gearbox portion 17 and the respective hook portions 24 and 25 of the gear cover 20. Therefore, drop of the gear cover 20 can be prevented more securely.

Further, the gear cover 20 includes the cover side wall portion 22 formed upright from the peripheral edge of the main body portion 21 configured to cover the driven gear 56 and the respective reduction gears 65 and 66. Thus, the cover side wall portion 22 functions as a rib so that the main body portion 21 can be less liable to be deflected. With this, the gear cover 20 is less liable to be deflected even when the load is applied from the platen roller 51 along the axial direction L2, thereby being capable of preventing disengagement of the respective hook portions 24 and 25. Therefore, the drop of the gear cover 20 can be prevented more securely.

Further, the gear cover 20 is formed to be elongated in the vertical direction L1 when viewed in the axial direction L2. Thus, when a load is applied from the platen roller 51 to the gear cover 20 along the axial direction L2, the gear cover 20 is to be deflected in the vertical direction L1. In this embodiment, the deflection direction of the respective hook portions 24 and 25 intersects the vertical direction L1. Thus, even when the load is applied from the platen roller 51 to the gear cover 20 along the axial direction L2 so that the gear cover 20 is deflected, a deflection direction of the gear cover 20 intersects the deflection direction of the respective hook portions 24 and 25, thereby being capable of preventing the disengagement of the respective hook portions 24 and 25 that may be caused due to the deflection of the gear cover 20. Thus, the drop of the gear cover 20 can be prevented more securely.

Further, the gear cover 20 is formed of a material having higher toughness than that of the main body frame 11. Thus, the gear cover 20 can be deflected under a state in which the respective projecting portions 26 and 27 of the gear cover 20 are fitted to the recessed portions 19 of the gearbox portion 17 so that the respective hook portions 24 and 25 of the gear cover 20 are engaged with the gearbox portion 17. Therefore, assembly of the gear cover 20 to the gearbox portion 17 can be facilitated.

Further, the thermal printer 1 of this embodiment includes the printing unit 10, thereby being capable of preventing the drop of the gear cover 20.

Note that, the present invention is not limited to the embodiment described above with reference to the drawings, and various modified examples may be employed within the technical scope of the present invention. For example, in the above-mentioned embodiment, the gear cover 20 is configured to close the entire opening of the gearbox portion 17 when viewed in the axial direction L2, but the present invention is not limited thereto. The gear cover may be configured to close a part of the opening of the gearbox portion 17.

Besides the above, the components in the above-mentioned embodiment may be replaced by well-known components as appropriate without departing from the gist of the present invention.

What is claimed is:

1. A printer unit comprising:

a platen roller including a driven gear;

a drive source configured to rotate the platen roller about a predetermined axis;

a frame, which is configured to rotatably support the platen roller and to which the drive source is assembled;

a reduction gear configured to transmit a driving force of the drive source to the driven gear in a decelerated manner;

a thermal head to be held in press contact with an outer peripheral surface of the platen roller;

a gearbox portion, which is formed on the frame and to which the driven gear and the reduction gear are assembled, the gearbox portion having an opening for assembling the reduction gear; and a gear cover configured to close at least a part of the opening of the gearbox portion, the gearbox portion having a recessed portion recessed in a direction intersecting an axial direction of the predetermined axis, the gear cover including:

a hook portion to be engaged with the gearbox portion; and a projecting portion to be fitted to the recessed portion of the gearbox portion.

2. A printer unit according to claim 1, wherein the gear cover is formed to be elongated in a predetermined direction when viewed in the axial direction, the projecting portion is formed on the driven gear side with respect to an intermediate portion of the gear cover in the predetermined direction when viewed in the axial direction, and the hook portion is formed on a side opposite to the projecting portion across the intermediate portion of the gear cover in the predetermined direction when viewed in the axial direction.

3. A printer unit according to claim 1, wherein the gear cover includes:

a main body portion configured to cover the driven gear and the reduction gear when viewed in the axial direction; and a side wall portion formed upright from a peripheral edge of the main body portion.

4. A printer unit according to claim 1, wherein the gear cover is formed to be elongated in a predetermined direction when viewed in the axial direction, and a deflection direction of the hook portion intersects the predetermined direction.

5. A printer unit according to claim 1, wherein the gear cover is formed of a material having higher toughness than that of the frame.

6. A printer comprising the printer unit according to claim 1.

* * * * *